United States Patent [19]

Whitaker

[11] Patent Number: 4,503,768

[45] Date of Patent: Mar. 12, 1985

[54] SINGLE PIECE HAMMER MODULE

[75] Inventor: C. Gordon Whitaker, Mercer Island, Wash.

[73] Assignee: Mannesmann Tally Corporation, Kent, Wash.

[21] Appl. No.: 512,470

[22] Filed: Jul. 11, 1983

[51] Int. Cl.[3] ..... B41J 7/70

[52] U.S. Cl. ..... 101/93.04

[58] Field of Search ..... 101/93.04, 93.05, 93.33, 101/93.34, 93.48, 111

[56] References Cited

U.S. PATENT DOCUMENTS

| | | | |
|---|---|---|---|
| 4,190,847 | 2/1980 | Stenudd | 101/93.48 |
| 4,233,894 | 11/1980 | Barrus et al. | 101/93.04 |
| 4,351,235 | 9/1982 | Bringhurst | 101/93.04 |

FOREIGN PATENT DOCUMENTS

| | | | |
|---|---|---|---|
| 0052202 | 5/1982 | European Pat. Off. | 101/93.34 |
| 0144175 | 11/1980 | Japan | 101/93.04 |
| 0152960 | 9/1982 | Japan | 101/93.05 |

OTHER PUBLICATIONS

IBM Technical Disclosure Bulletin "Method for Making a Multiple Hammer Element" by Hanna et al. vol. 24, No. 11A, Apr. 1982, p. 5482.

*Primary Examiner*—Paul T. Sewell
*Assistant Examiner*—John A. Weresh
*Attorney, Agent, or Firm*—Christensen, O'Connor, Johnson & Kindness

[57] ABSTRACT

A hammer module (11) for a dot matrix line printer including a cantilever mounted multi-arm hammer (23) formed from a single piece of resilient ferromagnetic material is disclosed. The multi-arm hammer (23) comprises a plurality of hammer arms (25) each including a thin spring region (51) and a thick head region (53) that lie in a plane that forms a slight angle with the plane of the base (27) of the multi-arm hammer (23). Each module also includes magnetic circuits for each hammer arm (25) formed by a common permanent magnet (13), a post (19), an arm (29) of a flux plate (15) and an arm (33) of a return plate (17). The post (19) is mounted on the tip of the flux plate arm (29). The flux plate and return plate arms (29 and 33) lie in parallel planes located on opposite sides (poles) of the permanent magnet (13). The posts (19), flux plate arms (29) and return plate arms (33) are sized and positioned such that the tip of the posts (19) lie coplanar with the outer surface of the return plate arms (33) and such that a gap exists between each post tip and an associated return plate arms (33). The head regions (53) of the print hammer arms (25) are positioned to be attracted to the post tip and the adjacent area of the return plate arms by the magnetic flux created by the permanent magnet (13) when coils (21) wrapped around the posts (19) are not energized. This attraction pulls the head regions 53 across the small gap created by the slight angle bend of the hammer arms (25). Thus, the thin spring region (51) of the hammer arms (25) is stressed, cocking the print hammer arms. When a coil (21) is energized, it produces a magnetic field that counteracts the permanent magnet attraction force, releasing the associated, cocked hammer arm (25). Releasing of the cocked hammer arm (25) impacts a ball (49), welded to the side of the hammer arm remote from the pole tip, against a ribbon to create a dot on a print receiving medium.

7 Claims, 6 Drawing Figures

SINGLE PIECE HAMMER MODULE

TECHNICAL AREA

This invention relates to dot matrix printers and, in particular, dot matrix line printers.

BACKGROUND OF THE INVENTION

In general, dot matrix printers can be separated into two categories—dot matrix line printers and dot matrix serial printers. Both categories of printers create images (characters or designs) by selectively printing a series of dots in an X-Y matrix. A dot matrix serial printer includes a head that is moved horizontally back and forth across a sheet of paper, either continuously or in steps. The head includes a vertical column of dot printing elements. As each column position of a character position is reached during printing, the required number of dot printing elements are actuated to form dots. A series of thusly created vertical dot columns forms the desired character. Contrariwise, dot matrix line printers include dot printing mechanisms for creating horizontal lines of dots substantially simultaneously as paper is stepped through the printer. A series of horizontal lines of dots creates an image, i.e., a row of characters or a design. The present invention is related to dot matrix line printers, as opposed to dot matrix serial printers.

In the past, various types of dot printing mechanisms for use in dot matrix line printers have been proposed and implemented. U.S. Pat. No. 4,351,235 assigned to the assignee of the present application and entitled "Dot Printing Mechanism for Dot Matrix Line Printers" describes a dot printing mechanism for a dot matrix line printer comprising a plurality of hammer modules mounted on a carriage that is shuttled back and forth along a print line. Each module includes a plurality of cantilevered print hammer arms formed of a resilient ferromagnetic material. Each print hammer arm includes two pieces—a thin resilient piece and a stiffener mounted on the end of the resilient piece. Mounted on the end of the stiffener is an anvil that prints a dot when the associated hammer arm is actuated.

Associated with each hammer arm of the dot printing mechanism described in U.S. Pat. No. 4,351,235 is a permanent magnet, a post and plates that create a ferromagnetic path between the permanent magnet and the post. The post supports a coil and is positioned near the stiffener end of the print hammer, on the side opposite the anvil. In the absence of current through the coil, the print hammer is attracted to the post by the magnetic field produced by the permanent magnet and, thus, cocked. The cocked hammers are released to create dots by energizing the coils such that the coils produce a magnetic field that counteracts the magnetic post attraction field created by the permanent magnet.

While dot printing mechanisms for dot matrix line printers of the type described in U.S. Pat. No. 4,351,235 have a number of advantages over prior dot printing mechanisms for such printers, and, thus, form a significant step forward in this art, it has been found that such dot printing mechanisms can be improved. In this regard, as noted above, the dot printing mechanism described in U.S. Pat. No. 4,351,235 includes a two-piece hammer arm. A two-piece hammer is undesirable because it is expensive to produce. Two pieces must be formed and welded together. Another disadvantage of such dot printing mechanisms results from the hammer impinging only on the tip of the coil post. Since the pole tip is small in size post wear is high, whereby the life of such dot printing mechanisms is shorter than desired. The present invention is directed to overcoming these disadvantages.

SUMMARY OF THE INVENTION

In accordance with this invention, a hammer module for a dot matrix line printer is provided. The hammer module includes a cantilever mounted multi-arm hammer. The multi-arm hammer comprises a plurality of hammer arms, each including a thin spring region and a thick head region, formed from a single piece of resilient ferromagnetic material. In addition to the multi-arm hammer, each module includes magnetic circuits for each hammer arm formed by a common permanent magnet, a post, an arm of a flux plate and an arm of a return plate. The post is mounted on the tip of the flux plate arm. The flux and return plates lie in parallel planes located on opposite sides (poles) of the permanent magnet. The posts, flux plate arms and return plate arms are sized and positioned such that the tip of the posts lie coplanar with the outer surface of the return plate arms. Further, a gap exists between the tips of the posts and their associated return plate arms. The head region of the single piece hammer arm is positioned to be attracted to and impinge on both the tip of the associated post and the end of the return plate arm. The attraction force is created by the magnetic flux produced by the permanent magnet when coils wrapped around the posts are not energized. The attraction force stresses the thin spring region of the hammer arms, resulting in the cocking of the hammer arms. When a coil is energized, it produces a magnetic field that counteracts the magnetic flux created by the permanent magnet. The counteracting magnetic flux releases the associated, cocked print hammer arm creating a force that impacts a ball welded to the opposite side of the print hammer arm against the ribbon of a print receiving mechanism. The ball impact presses the ribbon against a print receiving medium (e.g., a sheet of paper) to create a dot.

Cocking the thick head region of the hammer arm against the return plate arm as well as against the tip of the post greatly reduces the post wear problem associated with print hammer modules of the type described in U.S. Pat. No. 4,351,235. Further, one-piece hammer arms formed in accordance with the invention cost substantially less to produce than do two-piece hammer arms. Yet the mass advantages of hammer arms with enlarged heads is retained.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
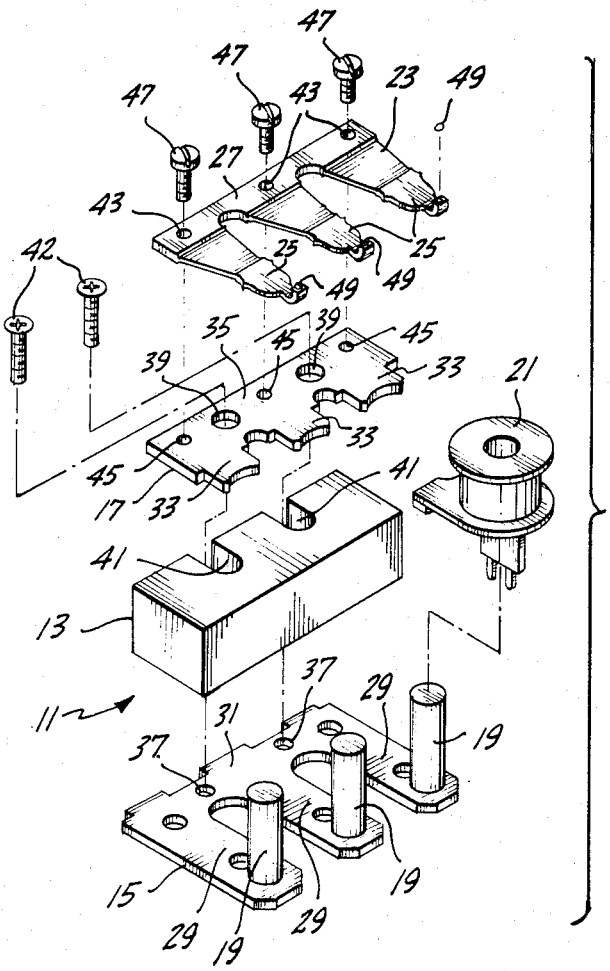
FIG. 1 is an exploded view of a preferred embodiment of a single piece hammer module formed in accordance with the invention.

As illustrated in FIG. 1, a single piece hammer module 11 formed in accordance with the invention comprises: a permanent magnet 13; a flux plate 15; a return plate 17; a plurality of cylindrical coil posts 19; a plurality of coils 21; and, a multi-arm hammer 23. The multi-arm hammer 23 illustrated in FIG. 1 includes three hammer arms 25 extending outwardly in a common plane from a base 27. Correspondingly, the illustrated flux plate 15 includes three arms 29 extending outwardly in a common plane from a base 31; and the illustrated return plate 17 includes three arms 33 extending outwardly in a common plane from a base 35. Further, the number of posts 19 and coils 21 illustrated is three. While the single-piece hammer module 11 is based on the multiple three (3), this multiple should not be construed as limiting, even though it is preferred. The multiple three (3) is preferred because it results in a conveniently sized module from a manufacturability viewpoint. Further, three (3) is divisable into sixty-six (66), the preferred number of dot printing elements for printing a standard one hundred and thirty-two (132) character line.

The permanent magnet 13 is an elongate permanent magnet having the shape of a rectangular parallelopiped. The polarization of the permanent magnet is such that one pole (e.g., the north pole) of the magnet lies along one longitudinal face and the other pole (e.g., the south pole) lies along the opposed longitudinal face. Mounted on one of the polarized faces of the elongated permanent magnet 13 is the base 35 of the return plate 17; and, mounted on the other polarized face is the base 31 of the flux plate 15. Thus, the planar flux and return plates 15 and 17 lie in parallel planes. Further, the arms 29 and 33 of the flux and return plates 15 and 17 are formed and positioned such that they are aligned with one another.

The base 31 of the flux plate 15 includes two threaded holes 37 located between the flux plate arms 29. Mounted on the outer end of each of the arms 29 of the flux plate 15 is one of the coil posts 19. The coil posts extend orthogonally outwardly from the plane of the flux plate 15 toward the return plate 17. The coil posts are attached to the arms, preferably by radial riveting the posts into holes in the arms. Mounted on each of the coil posts 19 is one of the coils 21.

The base 35 of the return plate 17 includes two countersunk holes 39 positioned between the return plate arms 33 so as to be alignable with a pair of slots 41 formed in the permanent magnet 13, which slots are, in turn, alignable with the threaded holes 37 formed in the base of the flux plate 15. A pair of non-magnetic, flat top screws 42, mounted in the countersunk holes 39 and the slots 41, are screwed into the threaded holes 37. As a result, when the flat top screws are tight, the permanent magnet 13 is clamped between the base 31 of the flux plate 15 and the base 35 of the return plate 17.

Figure 2:
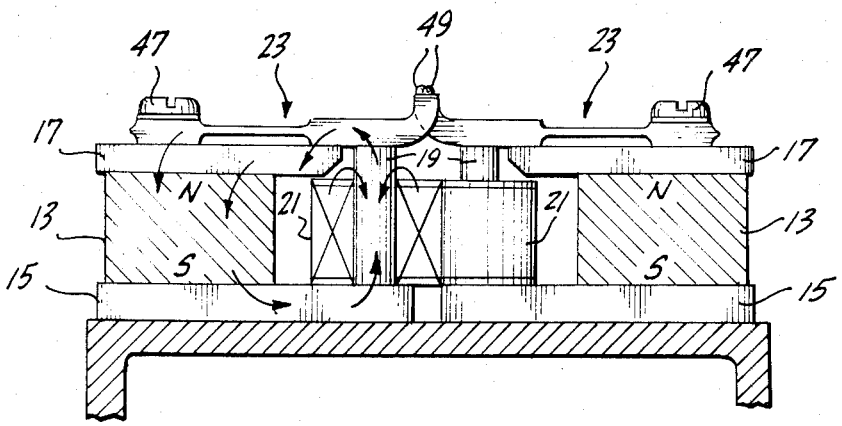
FIG. 2 is a cross-sectional view of a print hammer module of the type illustrated in FIG. 1 mounted on the carriage of a dot matrix line printer.
Figure 3:
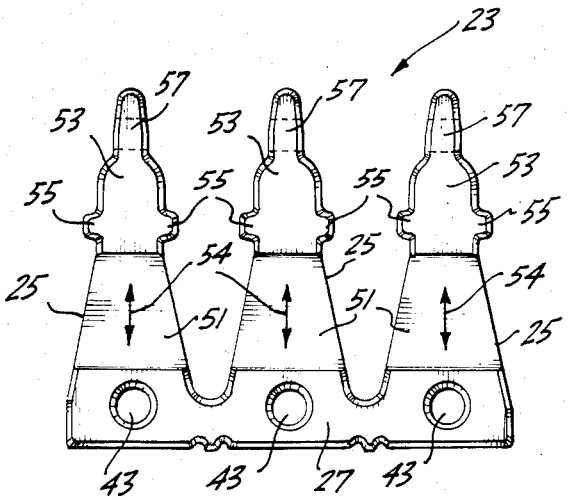
FIG. 3 is a plan view of a multi-arm hammer formed in accordance with the invention prior to being finally formed.

As best illustrated in FIG. 2, the length of the posts 19 is such that the outer surface of the tips of the posts 19 lie coplanar with the outer surface of the arms 33 of the flux plate 17. As best seen in FIG. 1, the tips of the arms 33 of the return plate 17 lying adjacent to the posts 19 are curved such that a constant space gap is formed between the curved periphery of the arms 33 and the adjacent peripheral surface of the posts 19.

The base 27 of the multi-arm hammer 23 includes three holes 43, each aligned with one of the hammer arms 25. The multi-arm hammer 23 is positioned such that its base 27 overlies the base 35 of the return plate 17. When so positioned, the holes 43 in the base 27 of the hammer bank 23 are aligned with three threaded holes 45 formed in the base 35 of the return plate 17. Screws 47 pass through the holes 43 formed in the base 27 of the multi-arm hammer 23 into the threaded holes 45 formed in the base 35 of the return plate 17. As a result, the base 27 of the multi-arm hammer 23 is attached to the base of the return plate 17.

As illustrated in FIGS. 3–6, in accordance with this invention, the multi-arm hammer 23 is formed from a single piece of ferromagnetic material. That is, the base 27 and arms 25 of the multi-arm hammer are integrally formed from a single planar piece of ferromagnetic material. Further, the various hereinafter described arm regions are all integral. The multi-arm hammer is formed from a sheet of suitable ferromagnetic material, such as 4130 alloy steel, by conventional chemical milling processes. In a conventional manner, undesired regions of material are chemically etched away (e.g., milled) to create hammer arms having the hereinafter described shape. After being formed, the tips of the print hammer arms are bent and print balls 49 are welded to the bent tips as more fully described below.

Figure 4:
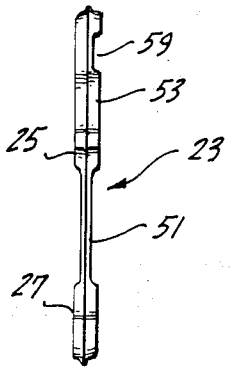
FIG. 4 is an end view of the multi-arm hammer illustrated in FIG. 3.
Figure 5:
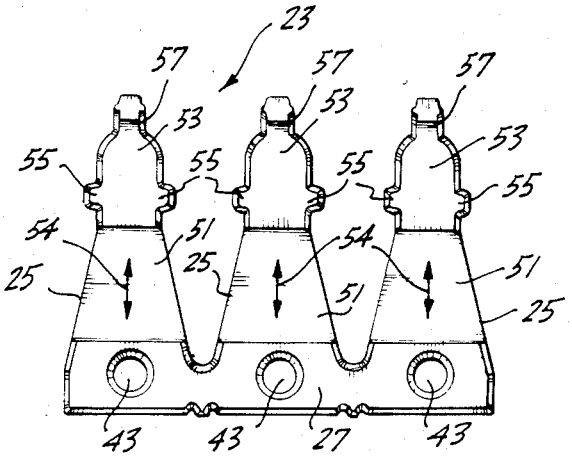
FIG. 5 is a plan view of the multi-arm hanmer illustrated in FIG. 3, after being finally formed.
Figure 6:
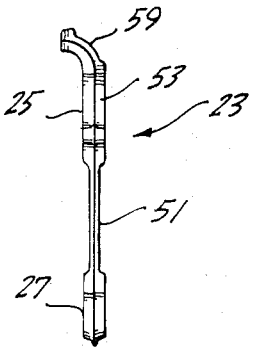
FIG. 6 is an end view of the multi-arm hammer illustrated in FIG. 5.

As best illustrated in FIGS. 4 and 6, the base 27 of the multi-arm hammer 23 is relatively thick. As described above, the hammer arms 25 lie in a common plane. Prior to bending the hammer arms in the manner hereinafter described, the hammer arm plane is coplanar with the plane of the base 27. Thus, the hammer arms 25 extend outwardly from the base all in the same direction, somewhat like the tines of a comb. Starting at the base 27, when viewed in cross section, the hammer arms 25 each include a thin spring region 51 followed by a thick head region 53. The thickness of the head region 53 is approximately the same as the thickness of the base 27. When viewed in the common plane of the base 27 and the arms 25, the thin spring regions 51 have the shape of an isosceles trapezoid, with the longer of the parallel sides of the trapezoid being integral with the base 27 of the multi-arm hammer 23. As will be readily appreciated by those skilled in the art, the isosceles trapezoidal shape of the thin spring regions 51 is by way of illustration. If desired, the thin spring regions could take on other shapes—rectangular, for example. The thick head regions 53 of the hammer arms 25 are integral with the shorter of the parallel sides of the trapezoidally shaped thin spring regions 51. The preferred hammer arm grain direction is shown by the arrows 54.

Starting at the outer end of the thin spring region 51, when viewed in a planar manner, edges of the thick head region 53 first extend outwardly along parallel lines. Projecting outwardly from the parallel edges are a pair of ears 55. A short distance beyond the ears 55, the edges of the thick head region 53 curve toward one another, terminating in a narrow tip 57. As illustrated in FIG. 4, material from one face of the tip 57 is removed in a region 59 lying between the end of the taper region and the end of the tip. Material is only removed from one face of the tip; the other face remains planar. The material is removed to allow the hereinafter described sharp bend radius to be achieved.

After the hammer bank 23 has been shaped in the manner described above, the tip 57 is bent through an arc of ninety degrees (90° ) and the end of the bent tip is machined flat. As illustrated in FIG. 6, the tip 57 is bent such that the region 59 lying between the end of the tapered region and the end of the tip where material is removed forms the outer side of the bend. After the outer end of the tip 57 is machined flat, the print ball 49 (FIG. 1) is attached to the flattened surface. Preferably, the print balls are formed of tungsten carbide and resistance welded to the ends of the tips 57 of the hammer arms 25.

The ears 55 are provided to furnish easily gripped lifting points for use in bending the hammer arms 25 away from the plane of the base such that the hereinafter described gap between hammer arms and the coil post tips and the ends of the return plate arms exists in the absence of a magnetic field. In other words, the hammer arms are bent such that the hammer arm plane is no longer coplanar with the plane of the base. The bend angle, of course, is extremely small.

In accordance with the invention, preferably, a wear resistant coating is applied to the surface of the head region 53 lying between the thin spring region 51 and the region 59 where material is removed from the tip 57. As illustrated in FIG. 2, it is this surface that impinges on the coil post tips and the adjacent outer surface of the arms 33 of the return plate 17. Preferably, the wear resistance coating is created by coating this area with a layer of dense chromium. While an electrolized coating is preferred, other coatings may be utilized, if desired, such as a particle enhanced eletroless nickel coating.

When assembled in the manner illustrated in FIGS. 1 and 2 and previously described, the permanent magnet 13 creates a magnetic field (shown by arrows in FIG. 2) that pulls the head regions 53 tightly against their associated coil post tips and the ends of the arms 33 of the return plate 17, which ends also form poles. In the absence of the magnetic field produced by the permanent magnet 13, the head regions 53 separates from the coil post tips and the ends of the arms of the return plates by a very small amount, preferably lying in the 16–20 thousandths of an inch range. When the permanent magnet pulls the head regions 53 acros this gap, against the coil post tips and the ends of the arms of the return plates, the thin regions 51 of the hammer arms 25 are stressed. When the thin regions are so stressed, the hammer arms are in a cocked state.

The coils 21 mounted on the posts 19 are energized in a manner that counteracts the magnetic force created by the permanent magnet. That is, current is applied to the coils in a direction that creates a magnetic field that counteracts the magnetic field produced by the permanent magnet. As a result, when current flows through one or more of the coils, the related hammer arm is released. Releasing the related hammer arm results in the energy stored in the stressed thin region 51 moving the end of the hammer arm and, thus, the ball 49 away from the coil post tip. This action results in the print ball impacting a ribbon against a suitable print receiving medium (e.g., paper) supported by a platen (not shown). As a result, a dot is printed on the print receiving medium. Current flow through the coil ends as the hammer arm rebounds from impact and the rebouding hammer arm is recocked because the head region 53 is pulled back against the tip of the post and the adjacent end of the arm of the return plate by the magnetic field produced by the permanent magnet.

As will be readily appreciated from the foregoing description, the invention overcomes the disadvantages of prior art print hammer mechanisms such as print hammer mechanisms of the type described in U.S. Pat. No. 4,351,235. More specifically, the provision of a single piece print hammer of the type herein described eliminates the need to weld a stiffener to a spring element resulting in a lower cost hammer bank. Further, impinging the hammer arm on the return plate as well as the post tip reduces post wear whereby print hammer mechanism life is considerably extended. Finally, the inclusion of a thick base, rather than using a separate clamp element, as in the case with the print hammer arrangement described in U.S. Pat. No. 4,351,235 further reduces hammer bank cost.

While a preferred embodiment of the invention has been illustrated and described, it will be appreciated that various changes can be made therein without departing from the spirit and scope of the invention. For example, while a three arm print hammer module has been illustrated and described, this number should be taken as exemplary. A print hammer module formed in accordance with the inventor can include a greater or lesser number of hammer arms, including a single hammer arm. Hence, the invention can be practiced otherwise than as specifically described herein.

The embodiments of the invention in which an exclusive property or privilege is claimed are defined as follows:

1. A print hammer module for a dot matrix line printer comprising:

a permanent magnet transversely polarized such that said permanent magnet has a pair of opposed polarized faces lying parallel to one another;

a flux plate formed of a magnetically permeable material having a base and at least one arm, said base mounted on one of said polarized faces of said permanent magnet such that said arm extends outwardly in the plane defined by said one of said polarized faces;

at least one coil post formed of a magnetically permeable material mounted on the end of said arm of said flux plate so as to overlie said permanent magnet;

at least one coil, said at least one coil mounted on said at least one coil post;

a return plate formed of a magnetically permeable material having a base and at least one arm, said base mounted on said other of said polarized faces of said permanent magnet such that said arm extends outwardly in the plane of said other of said polarized faces toward said coil post, the length of said at least one coil post being such that the tip of said at least one coil post lies substantially coplanar with the face of said return plate facing away from said permanent magnet;

a print hammer formed from a single piece of magnetically permeable material, said print hammer having a base and at least one arm, said base attached to said base of said return plate such that said at least one arm of said print hammer overlies said at least one arm of said return plate, said at least one arm of said print hammer including a thin resilient region and a thick head region, said thin resilient region beginning at said base and extending outwardly therefrom at a slight angle with respect to the plane of said base, said thick head region located at the outer end of said thin resilient region, the length of said at least one arm of said print hammer being such that said thick head region overlies the outer end of said arm of said return plate and the tip of said post and is attracted to and impinges on the outer end of the arm of said return plate and the tip of said post by the magnetic field produced by said permanent magnet in the absence of current flow in said coil; and, at least one print element attached to said thick head region of said print hammer on the side of said thick head region remote from said outer end of said at least one arm of said return plate and the tip of said post.

2. A print hammer module as claimed in claim 1, wherein said permanent magnet is an elongate permanent magnet transversely polarized with respect to the longitudinal axis of said permanent magnet.

3. A print hammer module as claimed in claim 2, wherein said flux plate, said return plate and said print hammer each have a plurality of aligned arms and including coil posts equal in number to the number of said plurality of arms, one of said coil posts mounted on the outer end of each of said arms of said return plate and, further, including a plurality of coils equal in number to the number of said plurality of coil posts, one of said coils mounted on each of said coil posts, each arm of said print hammer including a thin resilient region and a thick head region, said thin resilient regions beginning at said base of said print hammer and extending outwardly therefrom at a slight angle with respect to the plane of said base, said thick head regions located at the outer end of said thin resilient regions, the length of said arms of said print hammer being such that said thick head regions overlie the outer ends of said arms of said return plate and the tips of said posts and are attracted to and impinge on the outer ends of the arms of said return plate and the tips of said posts by the magnetic field produced by said permanent magnet in the absence of current flow in said coils and including print elements equal in number to the number of said plurality of arms, one of said print elements attached to the thick head region of each of the arms of said print hammer on the side thereof remote from said outer end of said arms of said return plate and the tips of said posts.

4. A print hammer module as claimed in claim 3, wherein the tips of the thick head regions of each of said plurality of arms of said print hammer are bent away from said coil posts and wherein said print elements each comprise a ball welded to the outwardly pointing tip of each of said plurality of arms of said print hammer.

5. A print hammer module for a dot matrix line printer as claimed in claim 4, wherein said thin resilient region of said arms of said print hammer have the planar shape of an isosceles trapezoid with the longer side thereof being integral with the base of said print hammer and the shorter side being integral with said thick head region.

6. A print hammer module as claimed in claim 1, wherein the tip of said thick head region of said at least one arm of said hammer is bent away from said coil post and wherein said print element comprises a ball welded to the outwardly pointing tip of said at least one arm of said print hammer.

7. A print hammer module for a dot matrix line printer as claimed in claim 1, wherein said thin resilient region of said at least one arm of said print hammer has the planar shape of an isosceles trapezoid with the longer side thereof being integral with the base of said print hammer and the shorter side being integral with said thick head region.

* * * * *